US006325008B1

(12) United States Patent
Aikyo

(10) Patent No.: US 6,325,008 B1
(45) Date of Patent: Dec. 4, 2001

(54) SEWING MACHINE WITH DRIVE FRAME

(75) Inventor: Kinya Aikyo, Ichinomiya (JP)

(73) Assignee: KabushikiKaisha Barudan, Aichi-ken (JP)

( * ) Notice: Subject to any disclaimer, the term of this patent is extended or adjusted under 35 U.S.C. 154(b) by 0 days.

(21) Appl. No.: 09/551,227

(22) Filed: Apr. 17, 2000

(30) Foreign Application Priority Data

Oct. 7, 1999 (JP) ..... 11-287427
Nov. 17, 1999 (JP) ..... 11-326568

(51) Int. Cl.[7] ..... D05B 21/00
(52) U.S. Cl. ..... 112/470.18
(58) Field of Search ..... 112/470.18, 470.06, 112/470.09

(56) References Cited

U.S. PATENT DOCUMENTS 5,081,944 * 1/1992 Nakanishi ..... 112/470.18
5,553,565 * 9/1996 Ono et al. ..... 112/470.18
5,809,918 * 9/1998 Tajima et al. ..... 112/470.18 X
5,887,536 * 3/1999 Hayashi ..... 112/470.18

* cited by examiner

*Primary Examiner*—Ismael Izaguirre
(74) *Attorney, Agent, or Firm*—Pillsbury Winthrop LLP

(57) ABSTRACT

A sewing machine includes a drive frame mounted on the table of the sewing machine and at least two Y-direction drive mechanisms arranged at a spacing in the right-and-left directions of the sewing machine for driving the drive frame in the back-and-forth directions of the dewing machine. The sewing machine includes an upper frame erected over the table. Each of the Y-direction drive mechanisms includes a rail mounted on the upper frame and extending in the back-and-forth directions of the sewing machine, a moving portion mounted on the rail slidably in the back-and-forth directions of the sewing machine and jointed to the drive frame, and a drive portion for driving the moving portion in the back-and-forth directions of the sewing machine.

6 Claims, 8 Drawing Sheets

SEWING MACHINE WITH DRIVE FRAME

BACKGROUND OF THE INVENTION

1. Field of the Invention

The present invention relates to a sewing machine which is provided with Y-direction drive mechanisms for moving a drive frame for tensing and holding a cloth to be worked, on the table of the sewing machine in the back and forth directions of the sewing machine.

2. Description of the Related Art

FIG. 8 shows a conventional sewing machine 50 which is provided with Y-direction drive mechanisms. This sewing machine 50 is provided for stitching both a cylindrical cloth and a flat cloth and is constructed to include: a lower frame 51 extending in a direction X (i.e., in the right-and-left directions of the sewing machine 50) and supported generally horizontally; a table 52 supported generally horizontally on said lower frame 51; an upper frame 53 erected over said table 52 and in parallel with the lower frame 51; a pair of machine heads 54 arrayed in the direction X in front of said upper frame 53; a pair of beds 55 arrayed on the lower frame 51 in such a manner to correspond to the individual machine heads 54 as to have upper faces generally flush with the upper face of the table 52; a drive frame 56 placed on the table 52; a pair of Y-direction drive mechanisms 57 for moving said drive frame 56 on the table 52 in a direction Y; and an X-direction drive mechanism 58 for moving the same in the direction X.

The bed 55 is provided with a base portion 55*a* supported on the lower frame, and a cylindrical portion 55*b* extending forward from said base portion 55*a*. The table 52 is composed of a stationary portion 52*a* arranged from the back side to the left and right side portions of the sewing machine 50, and a lift portion 52*b* arranged in a front side recess of said stationary portion 52*a*. The lift portion 52*b* can be moved downward from the bed 55 so that the flat cloth and the cylindrical cloth can be worked, respectively, in the states where the lift portion 52*b* is moved upward and downward.

The Y-direction drive mechanisms 57 are so disposed below the stationary portion 52*a* on the left and right sides of the lift portion 52*b*, respectively, that they may not interfere with the vertically moving lift portion 52*b* of the table 52. The both Y-direction drive mechanisms 57 are individually jointed through slits 52*c*, which are formed through the table 52 to extend in the direction Y, to the end portions of a root portion 59 of the drive frame 56, as extending in the right-and-left directions of the sewing machine 50. The root portion 59 has the X-direction drive mechanism 58 for driving a frame portion 60 of the drive frame 56 in the right-and-left directions of the sewing machine 50.

If the number of the machine heads 54 is increased, however, the distance between the two Y-direction drive mechanisms 57 is enlarged so that the root portion 59 of the drive frame 56 is liable to deflect at its central portion 59*a* when the Y-direction drive mechanisms 57 are actuated. When the drive frame 56 is driven in the direction Y, therefore, the central portion 59*a* of the root portion 59 seriously vibrates to raise a problem that the positioning accuracy of the drive frame 56 is lowered.

SUMMARY OF THE INVENTION

An object of the invention is to provide a sewing machine capable of driving a drive frame precisely.

According to an aspect of the invention, there is provided a sewing machine comprising: a drive frame to be mounted on the table of the sewing machine; and at least two Y-direction drive mechanisms arranged at a spacing in the right-and-left directions of the sewing machine for driving said drive frame in the back-and-forth directions of the sewing machine, characterized: by comprising an upper frame erected on said table; and in that each of said Y-direction drive mechanisms includes a rail mounted on said upper frame and extending in the back-and-forth directions of the sewing machine, a moving portion mounted on said rail slidably in the back-and-forth directions of the sewing machine and jointed to said drive frame, and a drive portion for driving said moving portion in the back-and-forth directions of the sewing machine.

The aforementioned sewing machine can be exemplified by a mode in which said Y-direction drive mechanisms are provided by two and are individually arranged inside, as seen in a top plan view, of the left and right end portions of said drive frame (that is, said Y-direction drive mechanisms are individually arranged inside of said drive frame in the right-and-left directions of the sewing machine).

On the other hand, there can be exemplified by a mode in which said Y-direction drive mechanisms are constructed to have their back end portions floating from said table so that they may not limit the movement of said drive frame backward of the sewing machine.

On the other hand, said sewing machine can be exemplified by a mode in which at least one of said Y-direction drive mechanisms is arranged inside, as seen in a top plan view, of the left and right end portions of said drive frame and constructed to have its back end portion floating from said table so that it may not limit the movement of said drive frame backward of the sewing machine.

On the other hand, said sewing machine can be exemplified by a mode in which said Y-direction drive mechanisms are provided by two, in which said table is constructed such that its front side portion in front of beds can be moved downward or removed, and in which said Y-direction drive mechanisms are individually arranged inside, as seen in a top plan view, of the left and right end portions of the front side portion of said beds.

On the other hand, there can be exemplified a mode in which said table is constructed such that its front side portion in front of beds can be moved downward or removed, in which at least one of said Y-direction drive mechanisms is arranged inside, as seen in a top plan view, of the left and right end portions of the front side portion of said beds and is constructed to have its back end portion floating from said table so that it may not limit the movement of said drive frame backward of the sewing machine.

The state in which the back end portion of said Y-direction drive mechanism floats from the table should not be especially limited, but can be exemplified by a mode in which the back end portion of the Y-direction drive mechanism is not jointed to said table or the machine frame below the upper face of said table.

The positions at which said Y-direction drive mechanisms are arranged should not be especially limited but are preferably located where the deflection of the entire drive frame can be made as small as possible.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
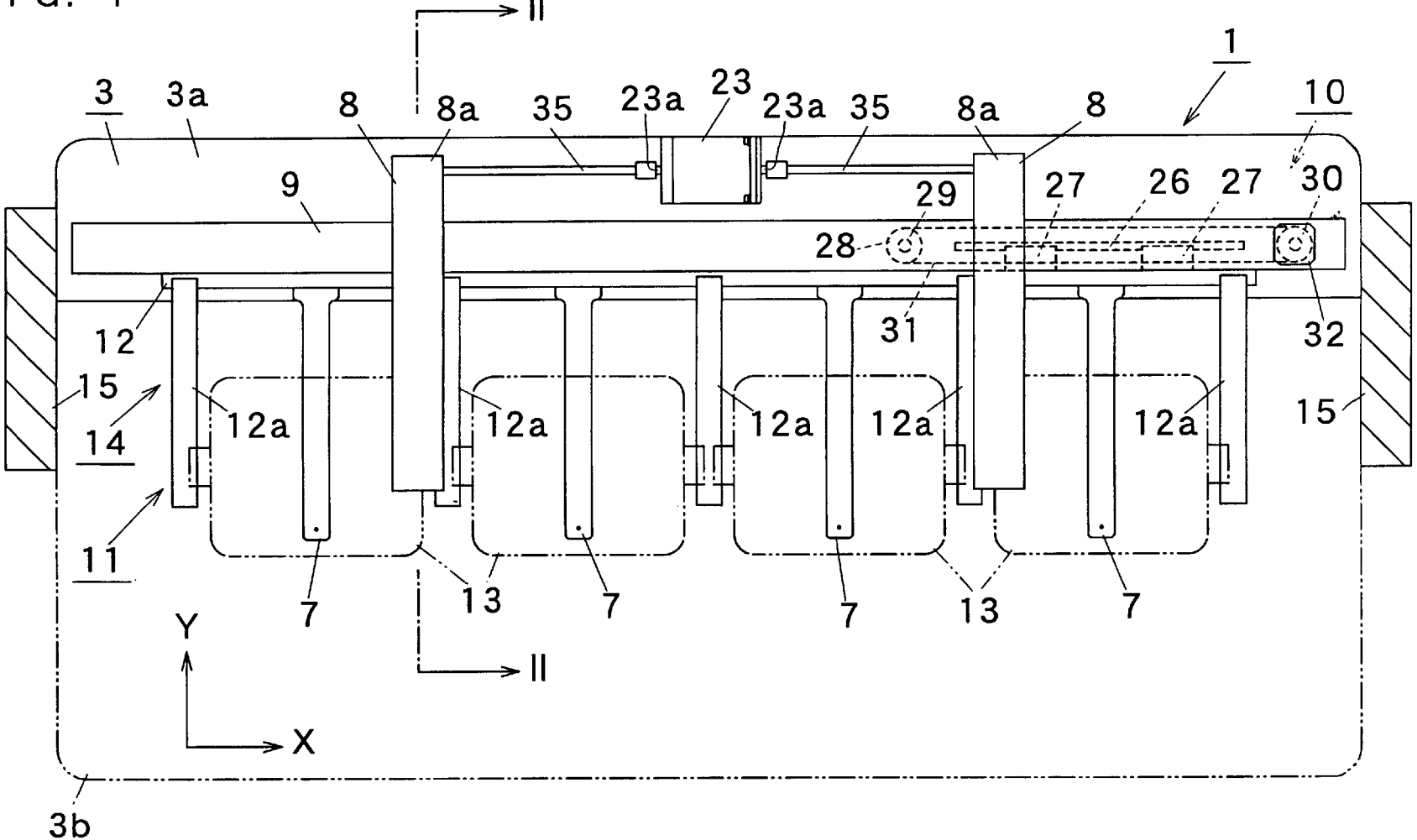
FIG. 1 is a sectional top plan view showing a sewing machine according to a first embodiment of the invention and is a section taken along line I—I of FIG. 2.
Figure 2:
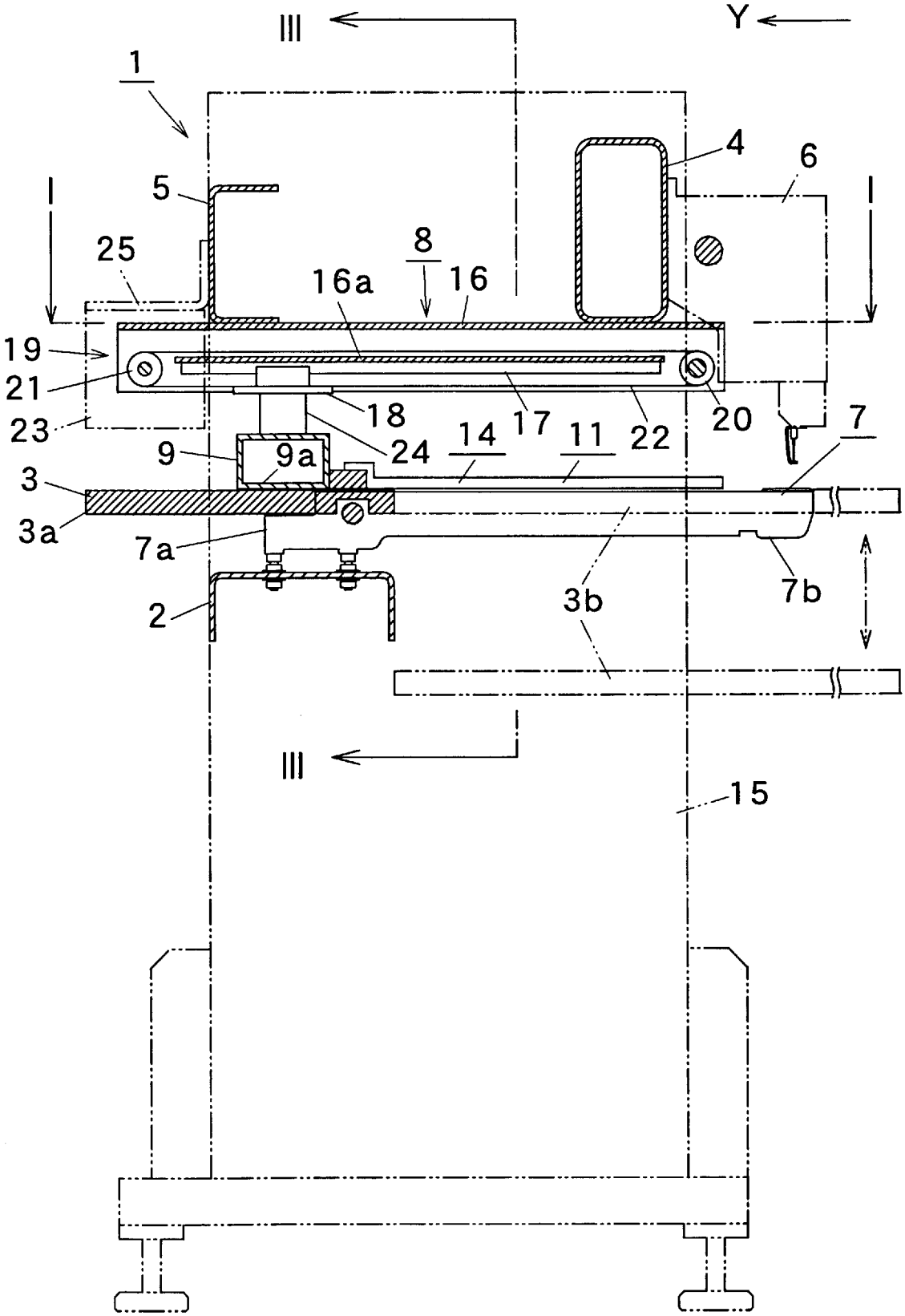
FIG. 2 is a section taken along line II—II of FIG. 1.
Figure 3:
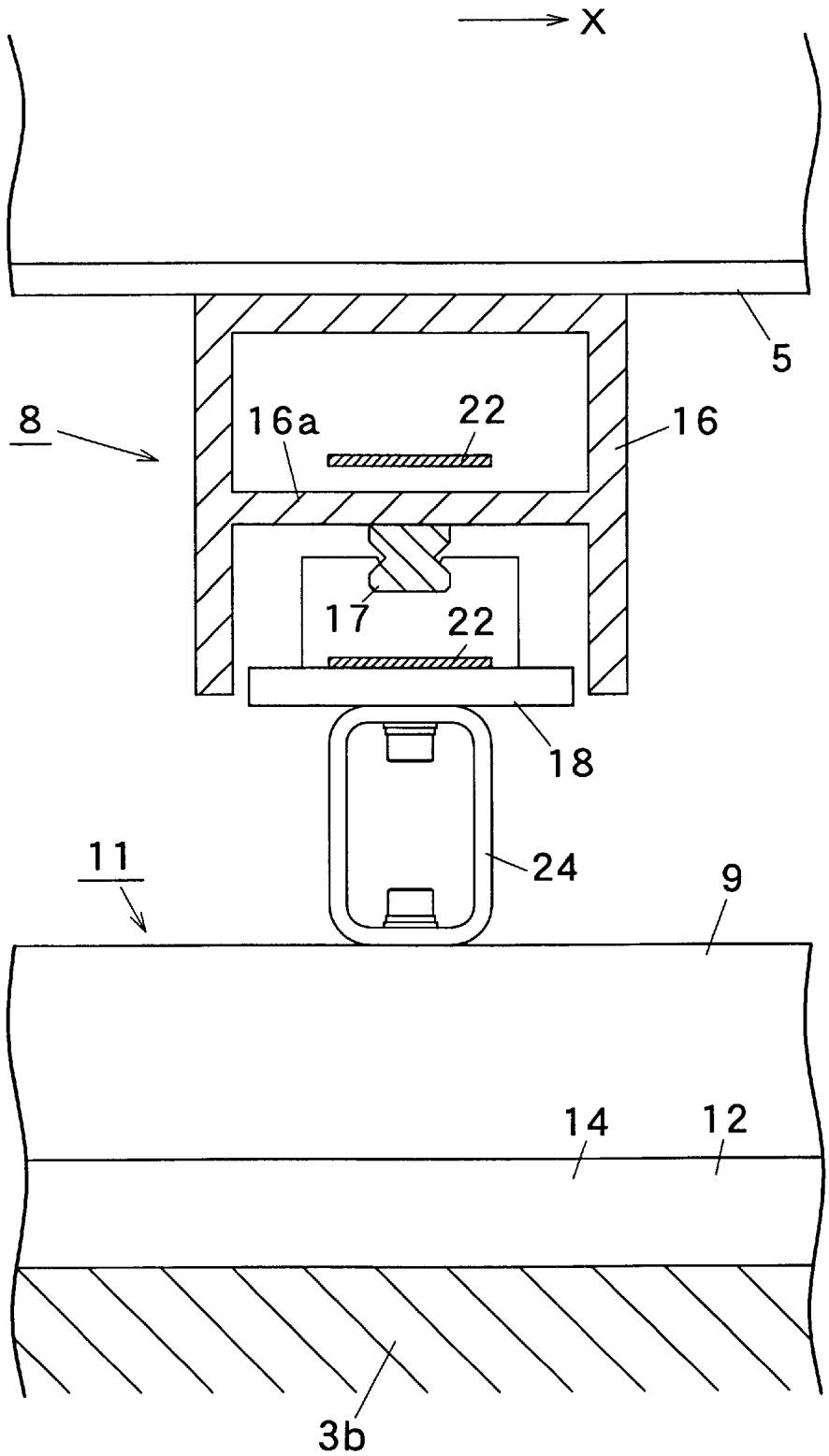
FIG. 3 is a section taken along line III—III of FIG. 2.

FIGS. 1 to 3 show a sewing machine 1 according to a first embodiment of the invention. This sewing machine 1 is provided for stitching both a cylindrical cloth and a flat cloth and is constructed to include: a pair of left and right columns 15 standing on the floor face; a lower frame 2 supported generally horizontally on said two columns 15 and extending in a direction X (i.e., in the right-and-left directions of the sewing machine 1); a table 3 supported generally horizontally on said lower frame 2; a first upper frame 4 erected on the two columns 15 over the table 3 and in parallel with the lower frame 2; a second upper frame 5 erected on the two columns 15 at the back of said first upper frame 4; four machine heads 6 arrayed in the direction X in front of the first upper frame 4; four beds 7 arranged on the lower frame 2 in such a manner to correspond to the individual machine heads 6 as to have upper faces generally flush with the upper face of the table 3; a pair of left and right Y-direction drive mechanisms 8 arranged at a spacing on the lower faces of the first upper frame 4 and the second upper frame 5 and extending in a direction Y (i.e., in the back-and-forth directions of the sewing machine); a root portion 9 of a drive frame 11 placed on the table 3 and jointed to the both Y-direction drive mechanisms 8; an X-direction drive mechanism 10 housed in said root portion 9; and a frame portion 14 of the drive frame 11 jointed to said X-direction drive mechanism 10. This frame portion 14 is provided with: a frame holder body 12 jointed to the X-direction drive mechanism 10 and extending in the direction X; frame holder arm portions 12*a* projected from said frame holder body 12 to the front of the sewing machine 1 and on the sides of the individual beds 7; and stitching frames 13 held on said frame holder arm portions 12*a* in a manner to correspond to the individual machine heads 6.

The bed 7 is provided with a base portion 7*a* supported on the lower frame 2, and a cylindrical portion 7*b* extending forward from said base portion 7*a*. The table 3 is composed of a stationary portion 3*a* arranged from the side of the base portion 7*a* of the bed 7 to the back side of the sewing machine 1, and a lift portion 3*b* arranged in front of said stationary portion 3*a* and acting as a front side portion. This lift portion 3*b* can be moved downward from the bed 7 and is constructed such that the stationary portion 3*a* and the lift portion 3*b* of the table 3 may be generally flush with the upper face of the bed 7 when the lift portion 3*b* lifts. In this state, the flat cloth is worked. In the state where the lift portion 3*b* is moved down, on the other hand, the cylindrical portion 7*b* of the bed 7 is exposed. In this state, moreover, the cylindrical cloth is worked.

The paired Y-direction drive mechanisms 8 are arranged inside, as seen in the top plan, of the left and right end portions of the drive frame 11 (that is, the paired Y-direction drive mechanisms 8 are individually arranged inside of the drive frame 11 in the direction X). Each Y-direction drive mechanism 8 is provided with: a rail base 16 mounted on the lower faces of the first upper frame 4 and the second upper frame 5 and extending in the direction Y; a rail 17 arranged on the lower face of a lower wall 16*a* of said rail base 16 and extending in the direction Y; a moving portion 18 mounted on said rail 17 in a manner to slide in the direction Y; and a drive portion 19 for driving said moving portion 18 in the direction Y. This drive portion 19 is provided with a driven pulley 20 and a drive pulley 21 disposed rotatably in front and at the back of the rail base 16, respectively, and a drive belt 22 made to run on the paired pulleys 20 and 21 via the upper side of the lower wall 16*a* of the rail base 16 and jointed to the front and back of the moving portion 18. To the drive pulleys 21 of the Y-direction drive mechanisms 8, moreover, there are jointed through drive shafts 35 the rotary shafts 23*a* of a drive motor 23. This drive motor 23 is mounted through a bracket 25 on the back face of the second upper frame 5. The moving portion 18 is jointed through a joint member 24 having a shape of a hollow pipe to the root portion 9 of the drive frame 11. Thus, the Y-direction drive mechanism 8 is so constructed to have its back end portion 8*a* floating from the table 3 as will not limit the movement of the drive frame 11 backward of the sewing machine.

The root portion 9 of the drive frame 11 is formed into a hollow square cylinder, in which the X-direction drive mechanism 10 is housed.

This X-direction drive mechanism 10 is provided for moving the frame portion 14 of the drive frame 11 in the direction X relative to the root portion 9 of the drive frame 11. The X-direction drive mechanism 10 is provided with: a rail 26 arranged on the upper face of the lower wall 9*a* of the root portion 9 and extending in the direction X; a pair of moving portions 27 disposed slidably in the direction X on said rail 26; and a drive portion 28 for driving said moving portions 27 in the direction X. The drive portion 28 is provided with a driven pulley 29 and a drive pulley 30 disposed rotatably on the left and right of the rail 26, respectively, and a drive belt 31 made to run on the two pulleys 29 and 30. This drive belt 31 is jointed to the paired moving portions 27. The drive pulley 30 is jointed to a drive motor 32. Each moving portion 27 is jointed to the frame holder body 12.

According to the sewing machine 1 thus constructed, all the Y-direction drive mechanisms 8 are disposed over the table 3 so that they makes no interference with the upward and downward movements of the lift portion 3*b* even if they are arranged inside (i.e., inside in the direction X), as seen in a top plan view, of the left and right end portions of the lift portion 3*b* of the table 3. As a result, the Y-direction drive mechanisms 8 can be suitably arranged at the optimum positions to minimize the deflection of the entirety of the root portion 9 of the drive frame 11, for example, thereby to drive the drive frame 11 precisely.

Thus, the Y-direction drive mechanisms 8 are disposed over the table 3 so that they can be arranged inside (i.e., inside in the direction X), as seen in a top plan view, of the left and right end portions of the lift portion 3*b* of the table 3 or the drive frame 11. As compared with the conventional sewing machine 50 in which the individual Y-direction drive mechanisms 57 are arranged below the stationary portion 52*a* on the left and right sides of the lift portion 52*b*, the sewing machine 1 can be narrowed in the direction X to reduce the space to be occupied by itself.

On the other hand, the Y-direction drive mechanisms 8 are constructed to have their back end portions 8*a* floating from the table 3 so that they may not limit the movements of the drive frame 11 backward of the sewing machine. When the back end portions 8*a* and the lower frame 2 are jointed by the joint member unlike this embodiment, for example, there arise problems (1) the backward movement of the drive frame 11 is limited by said joint member, and (2) the width of the sewing machine 1 has to be enlarged in the direction Y because the aforementioned joint member has to be accordingly extended backward as the backward moving range of the drive frame 11 is to be enlarged. None of these problems arises according to this embodiment. Therefore, the backward moving range of the root portion 9 of the drive frame 11 can be sufficiently retained without widening the sewing machine 1 in the direction Y.

Figure 4:
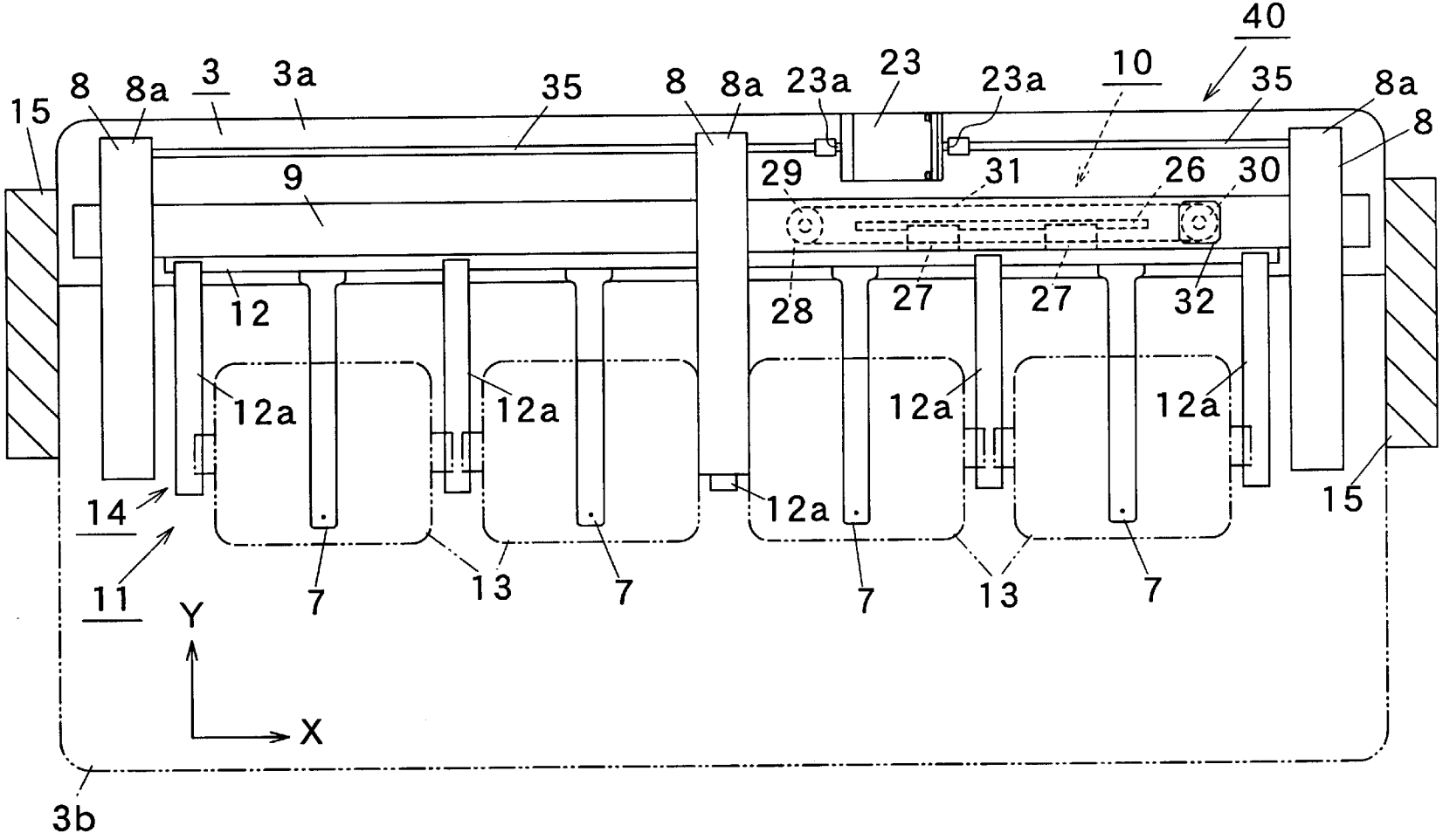
FIG. 4 is similar to FIG. 1 but is a sectional top plan view of a sewing machine according to a second embodiment of the invention.

Next, FIG. 4 shows a sewing machine 40 according to a second embodiment, and this sewing machine 40 is different from that of the first embodiment only in that another Y-direction drive mechanism 8 is added to the center of the sewing machine 40 in the direction X. In addition to the effects of the first embodiment, the addition can reduce the deflection at the longitudinal intermediate portion of the root portion 9 of the drive frame 11. According to this addition, on the other hand, the Y-direction drive mechanisms 8 on the left and right end sides are brought closer to the left and right end sides of the root portion 9 thereby to reduce the deflection at the end portion of the root portion 9. As a result, the deflection of the entirety of the root portion 9 of the drive frame 11 can be made less than that of the first embodiment so that the drive frame 11 can be driven more precisely.

In this embodiment, all the Y-direction drive mechanisms 8 are commonly made to have the fundamental structure so that their operational dispersion can be reduced to drive the drive frame 11 more precisely.

Figure 5:
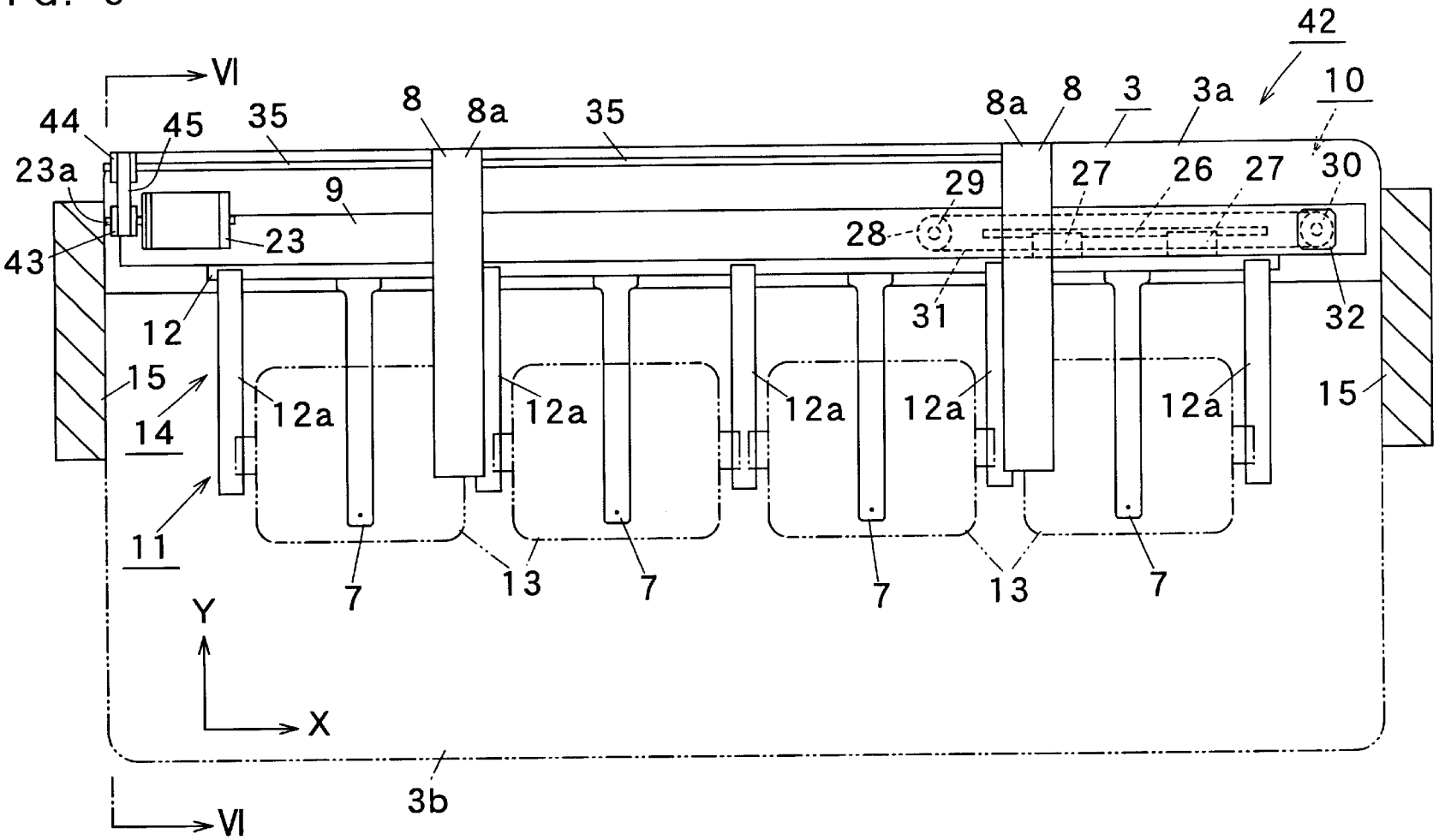
FIG. 5 is a sectional top plan view showing a sewing machine according to a third embodiment of the invention and is a section taken along line V—V of FIG. 6.
Figure 6:
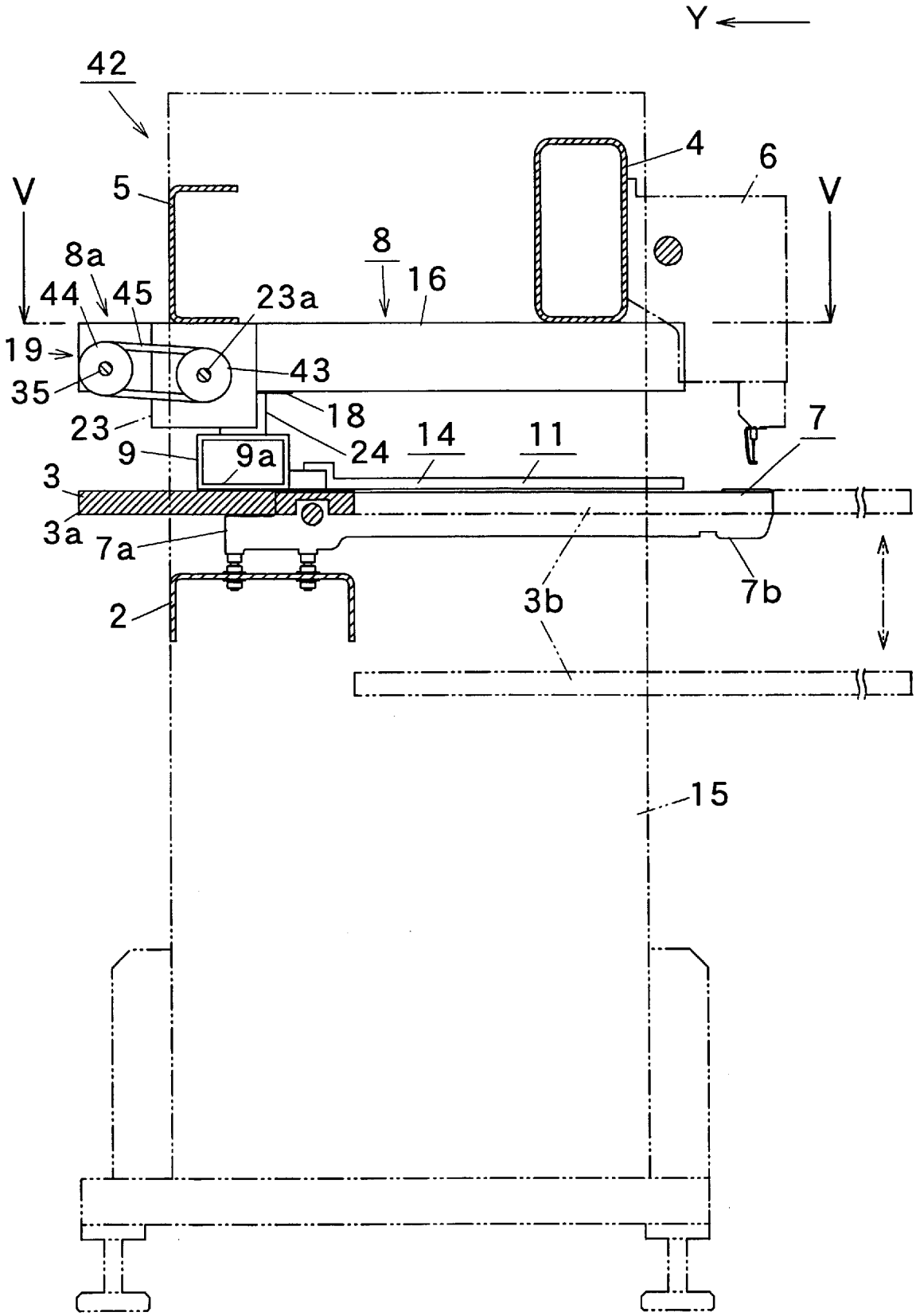
FIG. 6 is a section taken along line VI—VI of FIG. 5.

Next, FIGS. 5 and 6 show a sewing machine 42 of a third embodiment, which is different from that of the first embodiment only in the following points. Therefore, the repeated description of the portions similar to those of the first embodiment will be omitted by designating them by the identical reference numerals.

In this embodiment, the drive motor 23 is mounted on the lower face of the left side end portion of the second upper frame 5. Moreover, the rotating force of the rotary shaft 23*a* of the drive motor 23 is transmitted to the drive shaft 35 by a belt transmission mechanism which is constructed to include: pulleys 43 and 44 attached to the rotary shaft 23*a* and the drive shaft 35 of the drive motor 23, respectively; and a belt 45 made to run on said two pulleys 43 and 44.

In addition to the effects of the first embodiment, according to this embodiment, the drive motor 23 is prevented from protruding backward of the second upper frame 5 by mounting the drive motor 23 on the lower face of the second upper frame 5 so that the sewing machine 42 can be constructed to have a smaller width in the direction Y.

Figure 7:
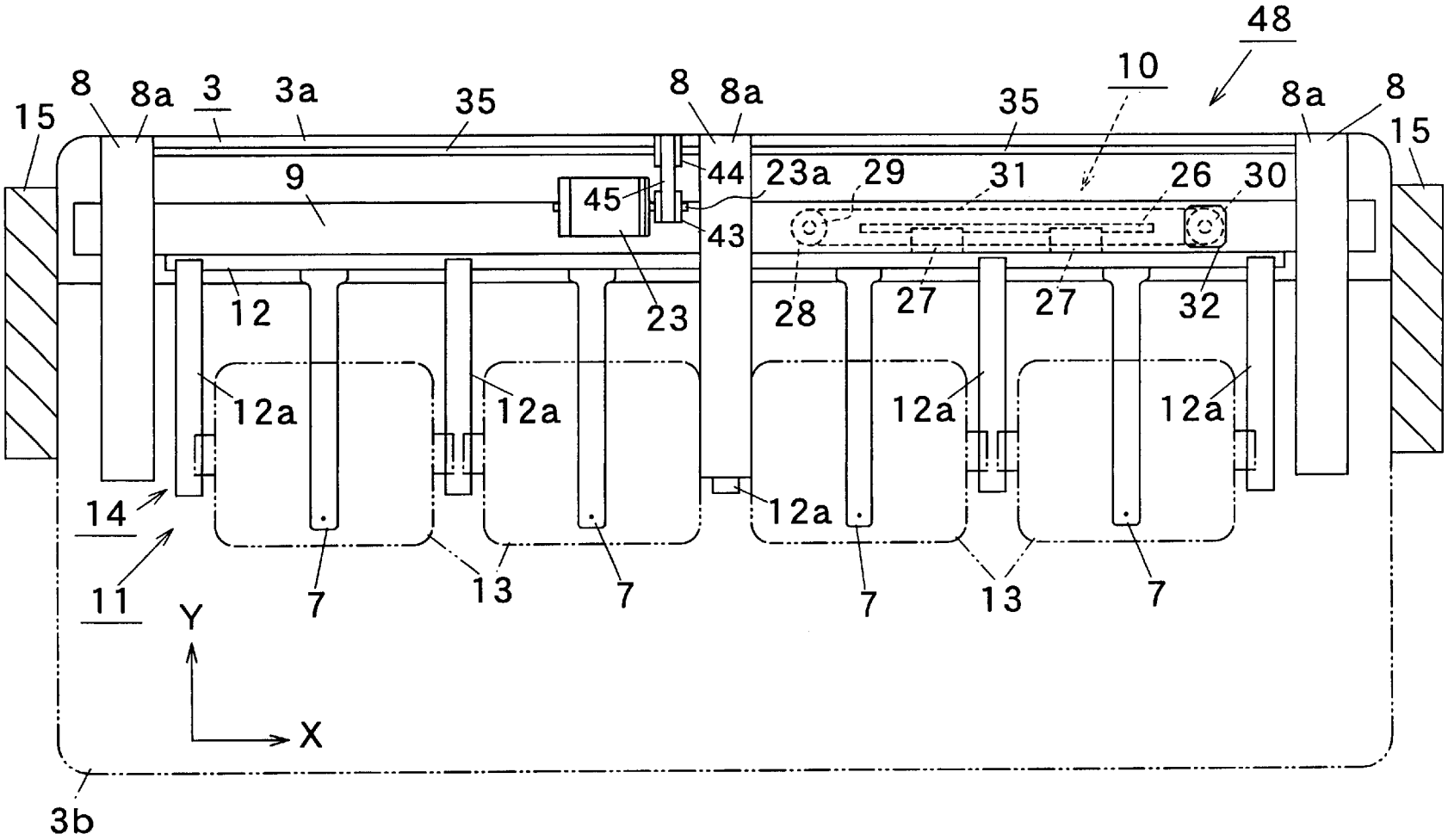
FIG. 7 is similar to FIG. 1 but is a sectional top plan view of a sewing machine according to a fourth embodiment of the invention.
Figure 8:
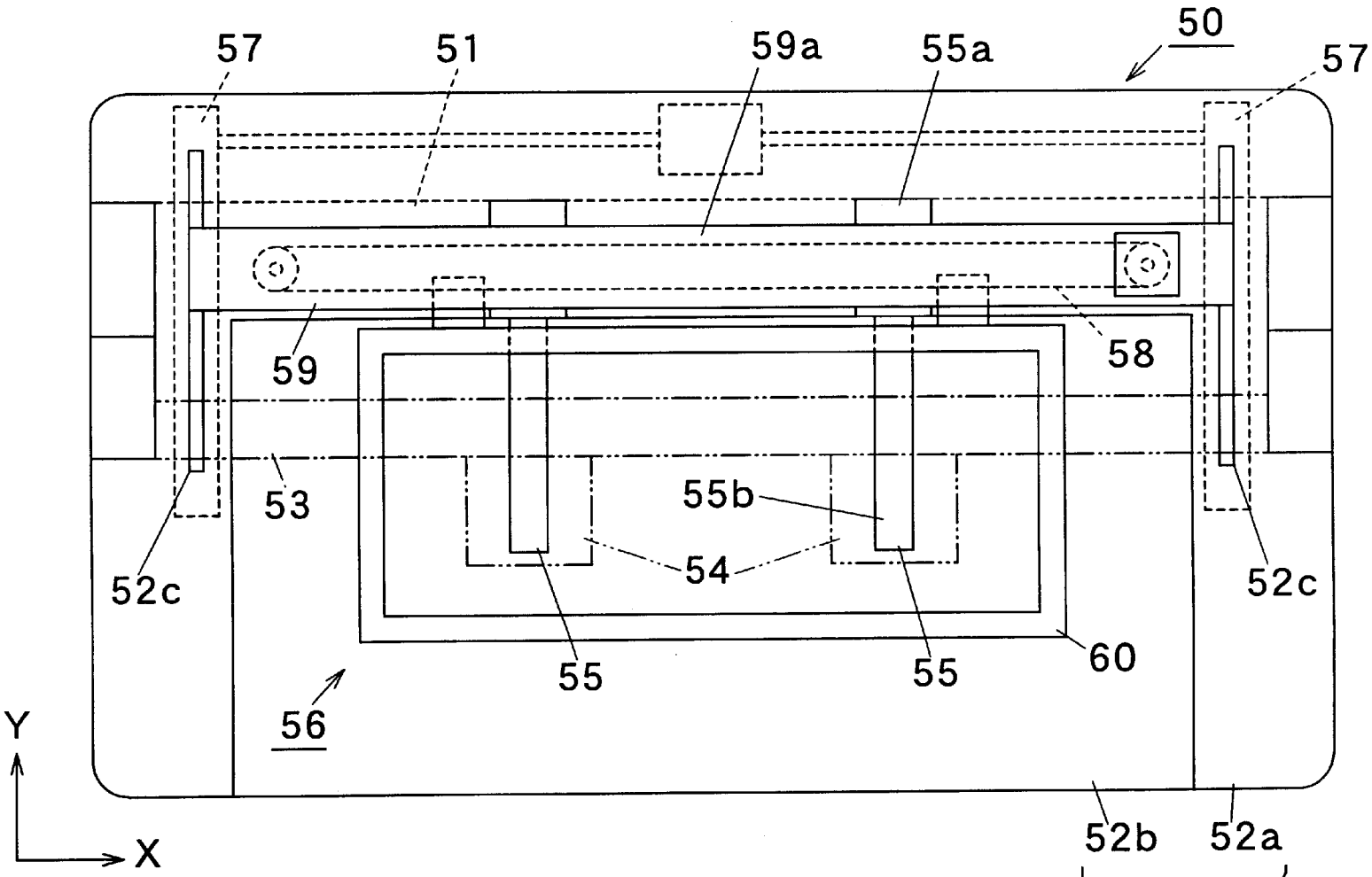
FIG. 8 PRIOR ART
FIG. 8 is a top plan view of a conventional sewing machine of the prior art.

Next, FIG. 7 shows a sewing machine 48 of a fourth embodiment. This sewing machine 48 is different from that of the second embodiment only in that the mounting position of the drive motor 23 is located on the lower face at the longitudinal center of the second upper frame 5, and in that the rotating force of the rotary shaft 23*a* of the drive motor 23 is transmitted to the drive shaft 35 by a belt transmission mechanism similar to that of the third embodiment. According to this embodiment, therefore, it is possible to achieve effects similar to those of the third embodiment in addition to the effects of the second embodiment.

Here, the invention should not be limited to the aforementioned constructions of the embodiments but can be embodied by modifying it suitably without departing from the gist thereof, as in the following:

(1) Four or more Y-direction drive mechanisms 8 are provided;

(2) The X-direction drive mechanism 10 is disposed below the table 3. In this table 3, there is formed a slit extending in the direction X. The X-direction drive mechanism 10 is jointed through said slit to the frame portion 14 of the drive frame 11. This drive frame 11 is provided at its root portion 9 with the frame portion 14 which can slide relatively in the direction X;

(3) In each of the embodiments, the mode in which the front side portion (3*b*) of the table 3 in front of the bed 7 can move downward is replaced by another in which said front side portion can be removed; and (4) In each of the embodiments, the frame holder arm portions 12*a* are removed from the frame holder body 12, and the stitching frames 13 for the individual beds 7 are replaced by a rectangular stitching frame for holding the cloth to be worked for the plurality of beds 7.

As many apparently widely different embodiments of this invention may be made without departing from the spirit and scope thereof, it is to be understood that the invention is not limited to the specific embodiments thereof except as defined in the appended claims.

What is claimed is:

1. A sewing machine, comprising:

a drive frame placed on a table of the sewing machine;

at least two Y-direction drive mechanisms arranged at a spacing in the right-and-left directions of the sewing machine for driving said drive frame in the back-and-forth directions of the sewing machine; and an upper frame erected over said table and provided with at least one machine head, wherein each of said Y-direction drive mechanisms includes a rail mounted on said upper frame and extending in the back-and-forth directions of the sewing machine, a moving portion mounted on said rail slidably in the back-and-forth directions of the sewing machine and jointed to said drive frame, and a drive portion for driving said moving portion in the back-and-forth directions of the sewing machine.

2. A sewing machine according to claim 1, wherein said at least two Y-direction drive mechanisms arc arranged inside of left and right end portions of said drive frame.

3. A sewing machine according to claim 1, wherein said at least two Y-direction drive mechanisms have back end portions floating from said table so as to not limit the movement of said drive frame backward of the sewing machine.

4. A sewing machine according to claim 1, wherein at least one of said Y-direction drive mechanisms is arranged inside left and right end sides of said drive frame and has a back end portion floating from said table so as to not limit the movement of said drive frame backward of the sewing machine.

5. A sewing machine according to claim 1, wherein there are two Y-direction drive mechanisms, said table includes a front side portion, in front of beds, that can be moved downward or removed, and said Y-direction drive mechanisms are arranged inside of left and right end portions of the front side portion of said beds.

6. A sewing machine according to claim 1, wherein said table includes a front side portion, in front of beds, that can be moved downward or removed, and at least one of said Y-direction drive mechanisms is arranged inside of left and right end portions of the front side portion of said beds and includes a back end portion floating from said table so as to not limit the movement of said drive frame backward of the sewing machine.

* * * * *